United States Patent [19]

Lahr et al.

[11] 3,949,853

[45] Apr. 13, 1976

[54] PROPORTIONAL-SPACED CHARACTER PRINT WHEEL

[75] Inventors: Roy Jeremy Lahr, Sierra Madre, Calif.; Frank M. Weller, Jr., Boulder, Colo.

[73] Assignee: Xerox Corporation, Stamford, Conn.

[22] Filed: Sept. 25, 1974

[21] Appl. No.: 509,195

[52] U.S. Cl. ..... 197/53

[51] Int. Cl.[2] ..... B41J 1/24

[58] Field of Search ..... 197/54, 53, 18, 48, 49, 197/50, 51, 52, 55, 6.2–6.7; 178/38, 34

[56] References Cited

UNITED STATES PATENTS

| | | | |
|---|---|---|---|
| 3,227,258 | 1/1966 | Pannier et al. | 197/54 X |
| 3,371,766 | 3/1968 | Staller | 197/53 |
| 3,455,428 | 7/1969 | Shida et al. | 178/34 X |
| 3,651,916 | 3/1972 | Becchi | 197/54 |
| 3,770,095 | 11/1973 | Guerrint et al. | 197/18 |
| 3,805,941 | 4/1974 | Cattaneo | 197/53 |
| 3,848,722 | 11/1974 | Bolan et al. | 197/53 |

OTHER PUBLICATIONS

Business Week Magazine, Feb. 1972, pp. 74 and 76.

*Primary Examiner*—Paul E. Shapiro

[57] ABSTRACT

A print wheel, for use with a serial impact printer, carrying a plurality of character elements at the outer periphery of radially-extending spokes. The print wheel of the present invention is characterized by the location layout of the characters around the periphery of the print wheel to allow the use of proportional-spaced characters.

3 Claims, 8 Drawing Figures

| SPOKE POSITION | CHARACTER SYMBOL | SPOKE POSITION | CHARACTER SYMBOL | SPOKE POSITION | CHARACTER SYMBOL |
|---|---|---|---|---|---|
| 0 (HOME) | w | | | | |
| 1 | z | 32 | ^ | 63 | I |
| 2 | y | 33 | \ | 64 | X |
| 3 | k | 34 | @ | 65 | ; |
| 4 | q | 35 | * | 66 | V |
| 5 | u | 36 | ( | 67 | J |
| 6 | p | 37 | ¦ | 68 | K |
| 7 | f | 38 | ) | 69 | Q |
| 8 | s | 39 | < | 70 | P |
| 9 | h | 40 | ` | 71 | Y |
| 10 | t | 41 | — | 72 | G |
| 11 | i | 42 | ' | 73 | U |
| 12 | a | 43 | [ | 74 | D |
| 13 | e | 44 | ~ | 75 | L |
| 14 | n | 45 | ] | 76 | I |
| 15 | r | 46 | > | 77 | N |
| 16 | o | 47 | { | 78 | O |
| 17 | c | 48 | = | 79 | H |
| 18 | b | 49 | % | 80 | T |
| 19 | l | 50 | # | 81 | E |
| 20 | d | 51 | + | 82 | S |
| 21 | x | 52 | ø | 83 | R |
| 22 | g | 53 | - | 84 | : |
| 23 | v | 54 | 9 | 85 | A |
| 24 | j | 55 | 8 | 86 | C |
| 25 | m | 56 | 7 | 87 | F |
| 26 | " | 57 | 6 | 88 | B |
| 27 | ø | 58 | 5 | 89 | Z |
| 28 | ! | 59 | 0 | 90 | M |
| 29 | } | 60 | 4 | 91 | . |
| 30 | / | 61 | 3 | 92 | W |
| 31 | ? | 62 | 2 | 93 | , |
| | | | | 94 | ø |
| | | | | 95 | ¬ |

PRIOR ART

FIG. 2

STATISTICAL USAGE OF 37 CHARACTERS IN AVERAGE ENGLISH

| CHARACTER | USAGE PER 1,000 |
|---|---|
| e | 118 |
| t | 90 |
| a | 78 |
| o | 73 |
| n | 70 |
| i | 70 |
| s | 59 |
| r | 58 |
| h | 52 |
| l | 39 |
| d | 36 |
| c | 28 |
| u | 27 |
| m | 24 |
| f | 22 |
| y | 20 |
| w | 20 |
| g | 19 |
| p | 18 |
| b | 15 |
| , (COMMA) | 12 |
| . (PERIOD) | 11 |
| v | 10 |
| - (DASH) | 7 |
| k | 6 |
| " (QUOTES) | 4 |
| ' (APOSTROPHE) | 2 |
| 0 (ZERO) | 2 |
| 1 (ONE) | 2 |
| x | 1 |
| j | 1 |
| 2 (TWO) | 1 |
| ; (SEMICOLON) | 1 |
| q | 1 |
| ? | 1 |
| z | 1 |
| : (COLON) | 1 |
| 37 | 1,000 |

FIG. 3

STATISTICAL USAGE OF FIFTEEN 2-CHARACTER COMBINATION IN AVERAGE ENGLISH

| CHARACTERS | USAGE PER 1,000 |
|---|---|
| TH | 168 |
| HE | 132 |
| AN | 92 |
| RE | 41 |
| ER | 88 |
| IN | 86 |
| ON | 71 |
| AT | 68 |
| ND | 61 |
| ST | 53 |
| ES | 52 |
| EN | 51 |
| OF | 49 |
| ED | 46 |
| TE | 46 |

FIG. 4

UNIT CHART

| ZONE WIDTH | ZONE | CHARACTERS |
|---|---|---|
| .0332 | 2 | Period, Apos. |
| .0498 | 3 | l-i-j-1-,-:-;-!-(-)- space |
| .0664 | 4 | f-r-s-t-/-"-Hyphen |
| .0830 | 5 | J-S-a-b-c-d-e-g-h-k-n-o-p-q-u-v-x-y-z-1-0-*-&-Ø-+-=-?- underscore |
| .0996 | 6 | -B-E-F-L-P-T-V-Z-#-$\frac{1}{4}$-$\frac{1}{2}$ |
| .1162 | 7 | A-C-D-G-H-K-N-O-Q-R-U-X-Y-w-8- |
| .1328 | 8 | M-W-m-%-@, |

FIG. 6

| SPOKE POSITION | CHARACTER SYMBOL | HEIGHT | WIDTH | SPOKE POSITION | CHARACTER SYMBOL | HEIGHT | WIDTH |
|---|---|---|---|---|---|---|---|
| 0 (HOME) | — | | | | | | |
| 1 | — | | | 32 | v | 0.0750 | 0.0738 |
| 2 | — | | | 33 | u | 0.0756 | 0.0750 |
| 3 | — | | | 34 | c | 0.0760 | 0.0684 |
| 4 | # | 0.1166 | 0.0675 | 35 | h | 0.1031 | 0.0735 |
| 5 | 9 | 0.1050 | 0.0600 | 36 | d | 0.1050 | 0.0731 |
| 6 | 8 | 0.1057 | 0.0600 | 37 | a | 0.0775 | 0.0738 |
| 7 | 7 | 0.1041 | 0.0575 | 38 | e | 0.0769 | 0.0681 |
| 8 | 6 | 0.1053 | 0.0600 | 39 | n | 0.0747 | 0.0753 |
| 9 | 5 | 0.1036 | 0.0584 | 40 | o | 0.0769 | 0.0718 |
| 10 | 0 | 0.1050 | 0.0594 | 41 | r | 0.0747 | 0.0550 |
| 11 | 4 | 0.1041 | 0.0656 | 42 | w | 0.0750 | 0.1030 |
| 12 | 3 | 0.1072 | 0.0582 | 43 | t | 0.1019 | 0.0519 |
| 13 | 2 | 0.1031 | 0.0566 | 44 | Q | 0.1303 | 0.0997 |
| 14 | 1 | 0.1035 | 0.0553 | 45 | s | 0.0750 | 0.0550 |
| 15 | ¼ | 0.1272 | 0.0613 | 46 | X | 0.1013 | 0.1031 |
| 16 | . | 0.0175 | 0.0175 | 47 | j | 0.1369 | 0.0388 |
| 17 | % | 0.1059 | 0.1150 | 48 | m | 0.0750 | 0.1144 |
| 18 | , | 0.0406 | 0.0200 | 49 | i | 0.1069 | 0.0347 |
| 19 | & | 0.1075 | 0.0985 | 50 | K | 0.1013 | 0.0981 |
| 20 | ( | 0.1362 | 0.0344 | 51 | f | 0.1094 | 0.0547 |
| 21 | @ | 0.1253 | 0.1078 | 52 | Y | 0.1016 | 0.1000 |
| 22 | ) | 0.1362 | 0.0344 | 53 | l | 0.1031 | 0.0425 |
| 23 | ½ | 0.1266 | 0.0656 | 54 | W | 0.1031 | 0.1154 |
| 24 | q | 0.1053 | 0.0734 | 55 | , | 0.0406 | 0.0200 |
| 25 | z | 0.0731 | 0.0671 | 56 | G | 0.1044 | 0.1000 |
| 26 | x | 0.0731 | 0.0750 | 57 | . | 0.0175 | 0.0175 |
| 27 | k | 0.1029 | 0.0735 | 58 | M | 0.1013 | 0.1163 |
| 28 | b | 0.1044 | 0.0731 | 59 | I | 0.1044 | 0.0197 |
| 29 | p | 0.1053 | 0.0734 | 60 | C | 0.1044 | 0.0980 |
| 30 | y | 0.1066 | 0.0766 | 61 | - | 0.0072 | 0.0600 |
| 31 | g | 0.1116 | 0.0769 | 62 | U | 0.1038 | 0.1000 |

FIG. 7

| SPOKE POSITION | CHARACTER SYMBOL | HEIGHT | WIDTH |
|---|---|---|---|
| 63 | " | 0.0522 | 0.0525 |
| 64 | D | 0.1013 | 0.1000 |
| 65 | / | 0.1284 | 0.0522 |
| 66 | O | 0.1059 | 0.0994 |
| 67 | : | 0.0690 | 0.0181 |
| 68 | R | 0.1031 | 0.1009 |
| 69 | ; | 0.0913 | 0.0206 |
| 70 | H | 0.1013 | 0.1000 |
| 71 | I | 0.1013 | 0.0409 |
| 72 | N | 0.1018 | 0.1000 |
| 73 | ' | 0.0525 | 0.0178 |
| 74 | F | 0.1016 | 0.0806 |
| 75 | J | 0.1025 | 0.0744 |
| 76 | L | 0.1013 | 0.0850 |
| 77 | T | 0.1013 | 0.0919 |
| 78 | A | 0.1031 | 0.1025 |
| 79 | ? | 0.1056 | 0.0516 |
| 80 | E | 0.1013 | 0.0838 |
| 81 | * | 0.0669 | 0.0600 |
| 82 | S | 0.1050 | 0.0719 |
| 83 | — | 0.0069 | 0.0875 |
| 84 | V | 0.1031 | 0.0931 |
| 85 | + | 0.0744 | 0.0700 |
| 86 | P | 0.1013 | 0.0819 |
| 87 | = | 0.0421 | 0.0688 |
| 88 | B | 0.1016 | 0.0869 |
| 89 | $ | 0.1347 | 0.0625 |
| 90 | Z | 0.1013 | 0.0819 |
| 91 | ¢ | 0.1019 | 0.0647 |
| 92 | — | | |
| 93 | — | | |
| 94 | — | | |
| 95 | — | | |

FIG. 7A

PROPORTIONAL-SPACED CHARACTER PRINT WHEEL

BACKGROUND OF THE INVENTION

The invention relates in general to impact printers and more particularly to the character or type-bearing print elements employed therewith.

It is well known in the art to use, is serial printers, print elements in the form of a wheel or the like. For example, see U.S. Pats. No. 2,236,663, 3,461,235, 3,498,439 and 3,651,916. A known location-layout of characters on a horizontal barrel-shaped type carrier is disclosed in U.S. Pat. No. 3,770,095.

The Diablo Corporation, a subsidiary of the present assignee, is marketing a serial printer under the tradename of Diablo Hytype I which employs a print wheel or disc-shaped type carrier. A printer of this type is disclosed in U.S. patent application filed Sept. 4, 1973, in the name of Andrew Gabor, Ser. No. 394,072, entitled "High Speed Printer With Intermittent Printer Wheel With Carriage Movement", being a continuation of an application filed Feb. 25, 1972, Ser. No. 229,314, the disclosure of which is incorporated by reference into this specification.

The Diablo Hytype I printer is enjoying commercial success as a serial printer in such applications as communication terminals, computer output devices, etc. With reference to FIG. 1 the print wheel employed in the Diablo Hytype I printer comprises a central hub section with 96 spokes or beams emanating therefrom and disposed in a circle concentric with the axis of rotation of the print wheel. A particular character slug is located at the outer end of each of the spokes. Print wheels are available for print-out at 10 or 12 pitch with all characters being allocated a width of approximately 0.0940 inches and 0.0830 inches, respectively, with the actual physical dimensions of the characters being less than the allocated values.

The character layout (FIG. 2) for the 10 and 12 pitch print wheels for the Diablo Hytype I printer was determined by use of a computer in conjunction with the "Statistical Usage of the 37 Characters in Average English" as shown in FIG. 3. Based on the character usage shown in FIG. 3, the primary objective was to layout the characters around the periphery of the print wheel so as to allow the fastest print speed possible. It can be seen that the faster printing would occur when the print wheel was required to rotate each character to be printed the shortest possible distance of rotation to a printing station.

The print wheel is rotated by a servo mechanism to position selected characters opposite a hammer and ribbon at the printing station. With reference again to FIG. 1, starting with the zero position which is the home position, which refers to home in the servo mechanism as well, each time the print wheel is moved so that a different character is positioned for printing at the printing station (which is the home position), the print wheel must be moved so that the centerline associated with the desired character is aligned to the print or home position. The diameter of the circle formed by a line connecting the centers of the characters of the print wheel for the Diable Hytype I printer is selected to be about 2.870 inches. The arc between character centerlines is about 3° 45′; therefore, for these parameters the length of the arc (at the center of the characters) between centerlines is about 0.0940 inches. The length of the arc at the bottom of a character will be less than that at the center or top of a character because of the reduction in the diameter associated with the arc at that location.

The escapement of the carriage of the Diable Hytype I printer along the platen is limited to increments of 1/60th of an inch; therefore, the characters must be of the proper width to allow for correct escapement. The character width must be somewhere in the zone of 1/60th of an inch or a multiple thereof and also be positioned on the print wheel so that when you have two characters spaced together, they do not overlap. For example, for the 12 pitch print wheel, if the width of any adjacent characters is increased from the allocated 0.0830 inches to a value greater than about 0.0940 inches, then the adjacent character slugs will interfere with and contact each other. The width of the print hammer is 0.060 inches which is less than the 0.0830 inches allocated for each character space around the 96 spoke print wheel; therefore, the hammer will not overlap a character slug and contact more than one character slug during a printing operation.

The 96 spoke print wheel employed in the Diablo Hytype I printer is formed of a thermoplastic by the process of one-piece injection molding. For structural strength, the character relief depth is about 0.015 inches and the character rake angle (the rise angle with respect to vertical) is about 15°, which causes the character slug to be wider and occupy more area than the area occupied by the character itself; the width of the character slug is limited by the available space of about 0.0940 inches between the centerlines of adjacent spokes.

The Diablo Hytype I printer is enjoying commercial success as an electronic printer capable of high speed and versatile operation. However, in certain applications, such as automatic text editing typewriter applications in the office environment, additional features and capabilites are desired. One such feature is the ability to print in a proportional space mode in addition to the 10 and 12 pitch modes. Another feature is the ability of the typist to view the typewritten material without such view being obscured by the print wheel. The print wheel of this invention provides proportional space printing capability in the operating conditions mentioned above.

Accordingly, it is a primary object of the instant invention to develop a print wheel suitable for proportional space printing.

Another object of our invention is to provide a print wheel suitable for proportional space printing which will not substantially reduce printing speed from that for 10 and 12 pitch print wheels.

A still further object of our invention is to provide a print wheel suitable for proportional space printing in the environment of automatic text editing typewriter applications.

Other objects and advantages will be evident from the specification and claims and the accompanying drawing illustrative of the invention.

BRIEF DESCRIPTION

These and other objects of the present invention are accomplished by the provision of an 88 spoke print wheel carrying a character element at the outer periphery of each of the radially extending spokes. The width of the proportional space characters is based upon an 8 zone system with Zones 2–8 being employed and having widths as follows: Zone 2 equals 0.0332 inches, Zone 3 equals 0.0498 inches, Zone 4 equals 0.0664 inches, Zone 5 equals 0.0830 inches, Zone 6 equals 0.0996 inches, Zone 7 equals 0.1162 inches and Zone 8 equals 0.1328 inches. In contrast, the width allocated to all characters on the prior art 10 and 12 pitch print wheels is approximately 0.0940 inches and 0.0830 inches, respectively, which is approximately equivalent to a width of 6 zones and 5 zones, respectively, of the present invention. Because of the widths allocated in the prior art, there are essentially no limitations upon the location of characters due to size while in the present invention characters whose widths lie, for example, in zones 7 and 8 cannot be placed on adjacent spokes because of their width.

Based upon the difference in widths of various characters and the statistical usage of the characters, the various characters are positioned around the periphery of the print wheel so as to allow high speed serial printing without interference between character slugs or between the print hammer and the character slugs and without a substantial reduction in print speed with reference to printing using the 10 and 12 pitch prior art print wheels.

DESCRIPTION OF THE DRAWINGS

Other advantages and features of the present invention may become more apparent from reading the following detailed description in connection with the drawings forming a part thereof, in which:

FIG. 2 is a chart of the character type location according to the prior art of FIG. 1.

FIG. 3 is a chart of the statistical usage of 37 characters in average English.

FIG. 4 is a chart of the statistical usage of 15 combinations in average English.

FIG. 6 is a chart of the zones allocated to the characters according to the invention herein.

FIGS. 7 and 7A is a chart of the character type location and approximate dimensions in inches according to the invention herein.

DETAILED DESCRIPTION

Figure 1:
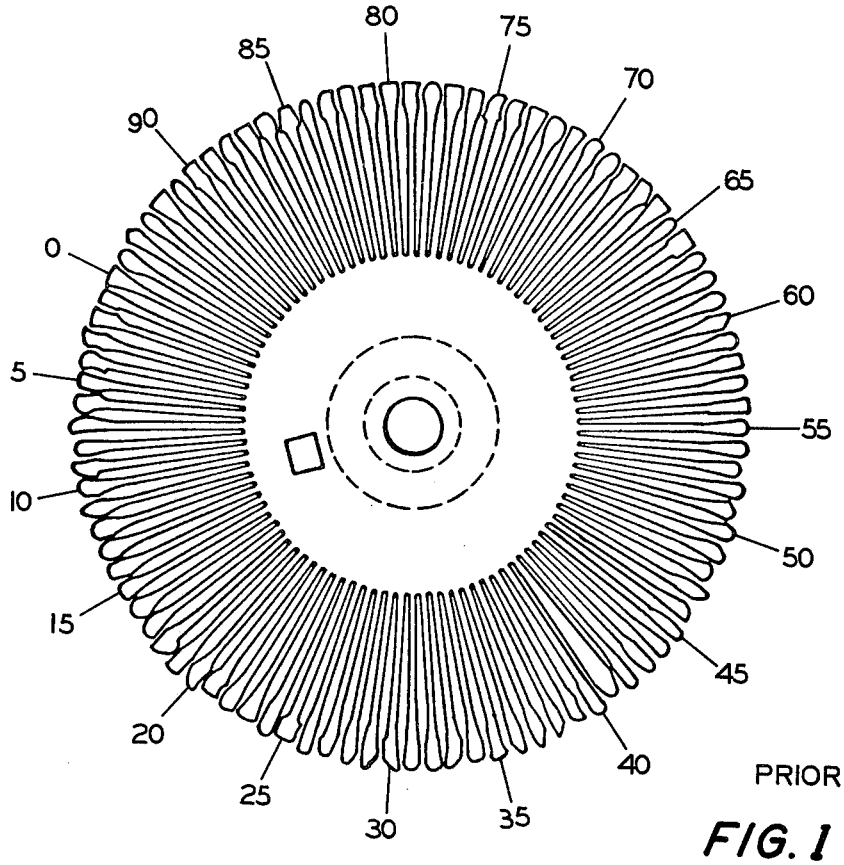
PRIOR ART FIG. 1
FIG. 1 is a plan view of a print wheel of the prior art.
Figure 5:
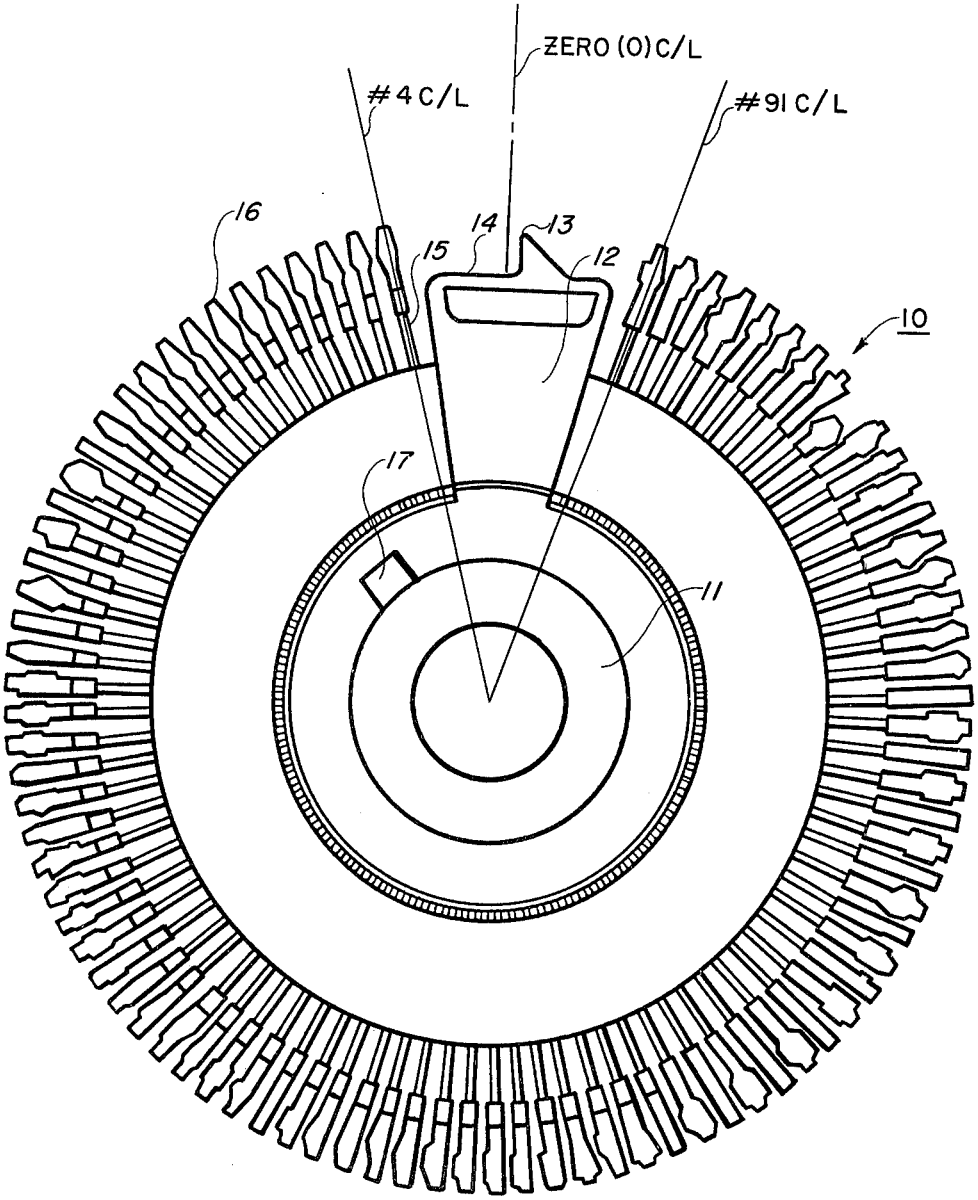
FIG. 5 is a plan view of a proportional space print wheel according to the invention herein.

Referring now to the drawings and more particularly to FIG. 5, there is shown one form of the print wheel of the present invention. The print wheel 10 comprises an inner central, or hub, portion 11 and a plurality of spokes, or beams, 15 extending therefrom. The hub 11 includes a key or notch 17 for aligning the print wheel 10 to a fixed angular position with respect to a positioning servo system. The hub 11 also includes a flag 12 extending radially outward amidst the spokes 15 and terminating in a pointer 13 and a flat portion 14 which provide a means to align the typed line with the print wheel 10 and allow viewing by the typist of the printed character. The distal, or outer, end of each spoke 15 is formed with a character slug 16 that has a character type formed on the printing surface of the character slug and an impact surface formed on the opposite side of the character slug. The printing surface of the character slug 16 faces the platen of the serial impact printer while the impact surface faces and is contacted by the print hammer when the character slug is rotated to the home or print position.

Each character slug 16 has a different character type thereon wherein a set, or font of character types is formed on the plurality of character slugs for each print wheel. The character rake angle is about 15°. There are a total of 88 spokes (with associated character slugs), each of which are aligned symmetrically with respect to a centerline of one of 88 of the equally spaced (3°45′) 96 centerlines designated with respect to the print wheel. The flag 12 occupies an area covering 8 of the 96 centerlines, which includes the zero (0), home or print position. The diameter of a circle formed by a line connecting the centers of the characters of the print wheel is about 2.870 inches which results in an arc distance between centerlines (at the center of the characters) of approximately 0.0940 inches. The length of the arc at the bottom of a character will be less because of the reduction in the diameter associated with the arc at that location.

The character slugs 16 are formed on the ends of the spokes 15 by the process of injection molding which suggests a minimum amount of material forming the mold between each of the character slugs. This minimum amount of material is specified to be approximately 0.005 inches in thickness and is required to prevent the pressures used in injection molding from breaking the material of the mold which form the separations between the character slugs. With the prior art 10 and 12 pitch print wheels, this needed separation space did not pose a problem since the width of the character plus the 0.005 inches totaled less than the 0.0940 inches of width available between centerlines of adjacent spokes.

In operation on the Diablo Hytype I printer, the print wheel is rotated by a positioning servo system until the centerline of the spoke carrying the desired character to be printed is aligned with the home or print position and then the servo system stops the wheel and the print hammer is activated. Upon receipt of a signal for the printing of any character, the servo system will rotate the wheel and then stop the wheel with the centerline, associated with the desired character, in the print position. The servo system will only position the wheel with respect to the defined centerlines.

Prior to the layout of the characters according to the present invention, the number and widths of the zones to be used is determined. The zone system increments are limited by the escapement of the printer while the overall maximum and minimum sizes of the characters are limited by the print wheel. The escapement of the present printer used in the environment of automatic text editing typewriter applications is 1/120 of an inch. With a print wheel whose diameter at the centers of the characters is approximately 2.870 inches and the escapement of 1/120 inch, the BOLD font of type (whose approximate dimensions are given in FIGS. 7 and 7A) is used in determining the character layout because it is selected to have the largest size, shape, white area, etc., for all fonts presently considered. This BOLD font of type is comparable to the commercially available IBM typeface of BOLD FACE 72.

Referring now to FIG. 6, the widths of the characters vary from 0.0332 inches (Zone 2) to 0.1328 (Zone 8) rather than being restricted to an approximate width of 0.0940 inches and 0.0830 inches as in the 10 and 12 pitch print wheels, respectively. It can be seen that four characters of Zone 7 width, such as Y, G, U, and D cannot be placed on adjacent character slugs as is done in the prior art print wheel as shown at centerline or spoke positions 71–74 to FIG. 2. Since the width of a Zone 7 character is allocated 0.1162 inches which exceeds the width of 0.0940 inches between centerlines for a character position (even without considering) the 0.005 inches of constraint due to molding), a Zone 7 character will extend into the space allocated for the adjacent characters, both in the clockwise and counterclockwise direction; therefore, the characters assigned to these two adjacent positions must be a character with a Zone 2 or 3 width or possibly a Zone 4 width, depending upon the particular shape of the characters. In locating characters of Zone 2 and 3 widths, care must be taken to insure that the characters placed adjacent thereto are not so close that the print hammer, when activated to cause printing of the character of Zone 2 or 3 width, will not also contact the adjacent character slugs. The print hammer is 0.060 inches in width and extends in width beyond the character of Zone 2 and 3 width.

The various character types can generally be grouped into outline shapes such as triangles (Δ,∇), squares (□), rectangles (□,▭), diamonds (◇), circles (○) and ovals (0, ⬭). The shapes of the characters as well as their particular width were also instrumental in determining their location around the print wheel. For example, character positions 29 (*p*) and 30 (*y*); character positions 74 (F) and 75 (J); character positions 76 (L), 77 (T) and 78 (A); etc.

With reference to FIGS. 5, 6 and 7, the print wheel in accordance with this invention, comprises a central member having a plurality of spokes extending radially outward therefrom and terminating in a character slug. The spokes are positioned along equivalent centerlines as those for the prior art 96 spoke print wheel. Moving counterclockwise from the zero or home position, the 1st, 12th, 20th, 71st, 73rd, 74th, 77th, 81st, 83rd, 85th and 87th spokes are allocated characters whose zone widths are 0.0996 inches. The 2nd, 3rd, 4th, 5th, 6th, 7th, 8th, 9th, 10th, 11th, 21st, 22nd, 23rd, 24th, 25th, 26th, 27th, 28th, 29th, 30th, 31st, 32nd, 33rd, 34th, 35th, 36th, 37th, 72nd, 76th, 78th, 79th, 80th, 82nd, 84th, 86th and 88th spokes are allocated characters whose zone widths are 0.0830 inches. The 38th, 40th, 42nd, 48th, 58th, 60th and 62nd spokes are allocated characters whose zone widths are 0.0664 inches. The 15th, 17th, 19th, 44th, 46th, 50th, 52nd, 56th, 64th, 66th and 68th spokes are allocated characters whose zone widths are 0.0498 inches. The 13th, 54th and 70th spokes are allocated characters whose zone widths are 0.0332 inches. The 16th, 39th, 41st, 43rd, 47th, 49th, 53rd, 57th, 59th, 61st, 63rd, 65th, 67th, 69th and 75th spokes are allocated character whose zone widths are 0.1162 inches. The 14th, 18th, 45th, 51st and 55th spokes are allocated characters whose zone widths are 0.1328 inches.

In summary, the constraints which necessitated relocation of character types around the periphery of the print wheel to provide proportional space capability rather than simply change character widths while leaving the characters in their prior positions were (1) the fixed diameter of the print wheel, (2) the fixed design of the servo system for positioning the print wheel, (3) the mold constraint of a minimum separation width between character slugs, (4) the width of the hammer and (5) retention of high speed print out.

The character types were positioned around the periphery of the print wheel taking into consideration the various widths of the characters and the constraints set forth above with only about a resulting 5% reduction of printout speed with reference to the prior art print wheel. The advantage of this invention is the provision of proportional space printing without the cost of a redesign of the printer which would have been necessary if the diameter of the print wheel had been increased and/or if the spoke positions had been changed.

The drawing and specification is directed to a right reading image, and it should be understood that the actual characters on the proportional-spaced print wheel are wrong-reading.

It is, therefore, evident that there has been provided in accordance with this invention a print wheel that fully satisfies the objects, aims and advantages set forth above. For example, a modification taught by this disclosure includes increasing the number of spokes and corresponding characters around the print wheel and decreasing the area occupied by the flag. A proportional-spaced print wheel suitable for European and non-English speaking countries has been developed employing 92 spokes and characters. While the principles of the invention have been made clear in the illustrative embodiment, it is apparent that alternatives, modifications and variations will be evident to those skilled in the art. Accordingly, it is intended to embrace all alternatives, modifications, and variations as fall within the spirit and broad scope of the appended claims.

What is claimed is:

1. A print wheel element of about 3 inch diameter for an impact printer comprising:

an inner central member having a plurality of spokes extending radially outward therefrom;

a character slug near the outer end of each spoke, said character slug including:

at the 1st, 12th, 20th, 71st, 73rd, 74th, 77th, 81st, 83rd, 85th and 87th spoke position, a printing surface shaped in the form of a character of zone width 0.0996 inches;

at the 2nd, 3rd, 4th, 5th, 6th, 7th, 8th, 9th, 10th, 11th, 21st, 22nd, 23rd, 24th, 25th, 26th, 27th, 28th, 29th, 30th, 31st, 32nd, 33rd, 34th, 35th, 36th, 37th, 72nd, 76th, 78th, 79th, 80th, 82nd, 84th, 86th and 88th spoke position, a printing surface shaped in the form of a character of zone width 0.0830 inches;

at the 38th, 40th, 42nd, 48th, 58th, 60th and 62nd spoke position, a printing surface shaped in the form of a character of zone width 0.0664 inches;

at the 15th, 17th, 19th, 44th, 46th, 50th, 52nd, 56th, 64th, 66th and 68th spoke position, a printing surface shaped in the form of a character of zone width 0.0498 inches;

at the 13th, 54th and 70th spoke position, a printing surface shaped in the form of a character of zone width 0.0332 inches;

at the 16th, 39th, 41st, 43rd, 47th, 49th, 53rd, 57th, 59th, 61st, 63rd, 65th, 67th, 69th and 75th spoke position, a printing surface shaped in the form of a character of zone width 0.1162 inches;

at the 14th, 18th, 45th, 51st and 55th spoke position, a printing surface shaped in the form of a character of zone width 0.1328 inches.

2. The print wheel of claim 1 wherein said character slugs include:

at the 1st, 2nd, 3rd, 5th, 6th, 7th, 9th, 10th, 21st, 29th, 59th and 88th spoke position, a printing surface area with an outline shape of an oval (0);

at the 4th, 26th, 27th, 28th, 30th, 39th, 49th, 51st, 74th and 81st spoke position, a printing surface area with an outline shape of a triangle (▽);

at the 8th, 11th, 16th, 24th, 25th, 32nd, 33rd, 34th, 72nd, 73rd, 75th and 80th spoke position, a printing surface area with an outline shape of a triangle (Δ);

at the 12th, 20th, 82nd and 86th spoke position, a printing surface are with an outline shape of a diamond (◇);

at the 13th, 15th, 17th, 19th, 38th, 40th, 42nd, 44th, 46th, 50th, 52nd, 54th, 56th, 62nd, 64th, 66th, 68th, 70th, 71st, 76th, 77th, 79th, 83rd, 85th and 87th spoke position, a printing surface area with an outline shape of a rectangle (▯);

at the 45th, 58th and 84th spoke position, a printing surface area with an outline shape of a rectangle (▭);

at the 14th, 22nd, 23rd, 36th, 43rd, 47th, 55th, 60th, 65th, 67th and 69th spoke position, a printing surface area with an outline shape of a square (□);

at the 18th, 31st, 35th, 37th, 41st, 53rd, 57th, 61st, 63rd and 78th spoke position, a printing surface area with an outline shape of a circle (O).

3. The print wheel of claim 1 wherein said character slugs include:

at the first spoke position, a printing surface shaped in the form of the character #;

at the second spoke position, a printing surface shaped in the form of the character 9;

at the third spoke position, a printing surface shaped in the form of the character 8;

at the fourth spoke position, a printing surface shaped in the form of the character 7;

at the fifth spoke position, a printing surface shaped in the form of the character 6;

at the sixth spoke position, a printing surface shaped in the form of the character 5;

at the seventh spoke position, a printing surface shaped in the form of the character 0;

at the eighth spoke position, a printing surface shaped in the form of the character 4;

at the ninth spoke position, a printing surface shaped in the form of the character 3;

at the tenth spoke position, a printing surface shaped in the form of the character 2;

at the eleventh spoke position, a printing surface shaped in the form of the character 1;

at the twelfth spoke position, a printing surface shaped in the form of the character ¼;

at the thirteenth spoke position, a printing surface shaped in the form of the character .;

at the fourteenth spoke position, a printing surface shaped in the form of the character %;

at the fifteenth spoke position, a printing surface shaped in the form of the character ,;

at the sixteenth spoke position, a printing surface shaped in the form of the character &;

at the seventeenth spoke position, a printing surface shaped in the form of the character (;

at the eighteenth spoke position, a printing surface shaped in the form of the character @;

at the nineteenth spoke position, a printing surface shaped in the form of the character );

at the twentieth spoke position, a printing surface shaped in the form of the character ½;

at the twenty-first spoke position, a printing surface shaped in the form of the character *q;* at the twenty-second spoke position, a printing surface shaped in the form of the character *z;* at the twenty-third spoke position, a printing surface shaped in the form of the character *x;* at the twenty-fourth spoke position, a printing surface shaped in the form of the character *k;* at the twenty-fifth spoke position, a printing surface shaped in the form of the character *b;* at the twenty-sixth spoke position, a printing surface shaped in the form of the character *p;* at the twenty-seventh spoke position, a printing surface shaped in the form of the character *y;* at the twenty-eighth spoke position, a printing surface shaped in the form of the character *g;* at the twenty-ninth spoke position, a printing surface shaped in the form of the character *v;* at the thirtieth spoke position, a printing surface shaped in the form of the character *u;* at the thirty-first spoke position, a printing surface shaped in the form of the character *c;* at the thirty-second spoke position, a printing surface shaped in the form of the character *h;* at the thirty-third spoke position, a printing surface shaped in the form of the character *d;* at the thirty-fourth spoke position, a printing surface shaped in the form of the character *a;* at the thirty-fifth spoke position, a printing surface shaped in the form of the character *e;* at the thirty-sixth spoke position, a printing surface shaped in the form of the character *n;* at the thirty-seventh spoke position, a printing surface shaped in the form of the character *o;* at the thirty-eighth spoke position, a printing surface shaped in the form of the character *r;* at the thirty-ninth spoke position, a printing surface shaped in the form of the character *w;* at the fortieth spoke position, a printing surface shaped in the form of the character *t;* at the forty-first spoke position, a printing surface shaped in the form of the character Q;

at the forty-second spoke position, a printing surface shaped in the form of the character *s;* at the forty-third spoke position, a printing surface shaped in the form of the character X;

at the forty-fourth spoke position, a printing surface shaped in the form of the character *j;* at the forty-fifth spoke position, a printing surface shaped in the form of the character *m;* at the forty-sixth spoke position, a printing surface shaped in the form of the character *i;* at the forty-seventh spoke position, a printing surface shaped in the form of the character K;

at the forty-eighth spoke position, a printing surface shaped in the form of the character *f;* at the forty-ninth spoke position, a printing surface shaped in the form of the character Y;

at the fiftieth spoke position, a printing surface shaped in the form of the character *l;* at the fifty-first spoke position, a printing surface shaped in the form of the character W;

at the fifty-second spoke position, a printing surface shaped in the form of the character ,;

at the fifty-third spoke position, a printing surface shaped in the form of the character G;

at the fifty-fourth spoke position, a printing surface shaped in the form of the character .;

at the fifty-fifth spoke position, a printing surface shaped in the form of the character M; at the fiftysixth spoke position, a printing surface shaped in the form of the character !;
at the fifty-seventh spoke position, a printing surface shaped in the form of the character C;
at the fifty-eighth spoke position, a printing surface shaped in the form of the character -;
at the fifty-ninth spoke position, a printing surface shaped in the form of the character U;
at the sixtieth spoke position, a printing surface shaped in the form of the character ";
at the sixty-first spoke position, a printing surface shaped in the form of the character D;
at the sixty-second spoke position, a printing surface shaped in the form of the character /;
at the sixty-third spoke position, a printing surface shaped in the form of the character O;
at the sixty-fourth spoke position, a printing surface shaped in the form of the character :;
at the sixty-fifth spoke position, a printing surface shaped in the form of the character R;
at the sixty-sixth spoke position, a printing surface shaped in the form of the character ;;
at the sixty-seventh spoke position, a printing surface shaped in the form of the character H;
at the sixty-eighth spoke position, a printing surface shaped in the form of the character I;
at the sixty-ninth spoke position, a printing surface shaped in the form of the character N;
at the seventieth spoke position, a printing surface shaped in the form of the character ';
at the seventy-first spoke position, a printing surface shaped in the form of the character F;
at the seventy-second spoke position, a printing surface shaped in the form of the character J;
at the seventy-third spoke position, a printing surface shaped in the form of the character L;
at the seventy-fourth spoke position, a printing surface shaped in the form of the character T;
at the seventy-fifth spoke position, a printing surface shaped in the form of the character A;
at the seventy-sixth spoke position, a printing surface shaped in the form of the character ?;
at the seventy-seventh spoke position, a printing surface shaped in the form of the character E;
at the seventy-eighth spoke position, a printing surface shaped in the form of the character *;
at the seventy-ninth spoke position, a printing surface shaped in the form of the character S;
at the eightieth spoke position, a printing surface shaped in the form of the character _;
at the eighty-first spoke position, a printing surface shaped in the form of the character V;
at the eighty-second spoke position, a printing surface shaped in the form of the character +;
at the eighty-third spoke position, a printing surface shaped in the from of the character P;
at the eighty-fourth spoke position, a printing surface shaped in the form of the character =;
at the eighty-fifth spoke position, a printing surface shaped in the form of the character B; at the eighty-sixth spoke position, a printing surface shaped in the form of the character $;
at the eighty-seventh spoke position, a printing surface shaped in the form of the character Z; and
at the eighty-eighth spoke position, a printing surface shaped in the form of the character ¢ .

* * * * *

UNITED STATES PATENT AND TRADEMARK OFFICE

CERTIFICATE OF CORRECTION

PATENT NO. : 3,949,853

DATED : April 13, 1976

INVENTOR(S) : Roy Jeremy Lahr and Frank M. Weller, Jr.

It is certified that error appears in the above-identified patent and that said Letters Patent are hereby corrected as shown below:

Column 7, line 9, "are" should read --area--.

Column 7, line 12, after "46th", insert --48th--.

Signed and Sealed this

Twelfth Day of October 1976

[SEAL]

*Attest:*

RUTH C. MASON
*Attesting Officer*

C. MARSHALL DANN
*Commissioner of Patents and Trademarks*